US006547245B1

(12) United States Patent
Olutunfese

(10) Patent No.: US 6,547,245 B1
(45) Date of Patent: Apr. 15, 2003

(54) EDUCATIONAL GAME

(76) Inventor: Christopher O. Olutunfese, 361 Abbott Road, London E14 0NG (GB)

( * ) Notice: Subject to any disclaimer, the term of this patent is extended or adjusted under 35 U.S.C. 154(b) by 0 days.

(21) Appl. No.: 09/785,142

(22) Filed: Feb. 16, 2001

(51) Int. Cl.[7] ..... A63F 3/00
(52) U.S. Cl. ..... 273/248; 273/236; 273/430
(58) Field of Search ..... 273/236, 243, 273/248, 430, 292, 300, 302

(56) References Cited

U.S. PATENT DOCUMENTS

| | | | | | |
|---|---|---|---|---|---|
| 3,815,919 | A | * | 6/1974 | Cain et al. | 273/249 |
| 3,952,423 | A | | 4/1976 | Gentry | |
| 4,121,823 | A | * | 10/1978 | McBride | 273/249 |
| D252,344 | S | | 7/1979 | Parker et al. | |
| 4,201,388 | A | * | 5/1980 | Cantelon | 273/251 |
| 4,441,718 | A | | 4/1984 | Olson | |
| 4,932,667 | A | * | 6/1990 | Gorski et al. | 273/249 |
| 5,042,816 | A | * | 8/1991 | Davis et al. | 273/243 |
| 5,092,606 | A | * | 3/1992 | Miller | 273/249 |
| 5,152,535 | A | * | 10/1992 | Roberts | 273/249 |
| 5,224,862 | A | * | 7/1993 | Sullivan | 273/243 |
| 5,295,834 | A | * | 3/1994 | Saunders | 273/249 |
| 5,377,991 | A | * | 1/1995 | Olsen | 273/249 |
| 5,449,177 | A | | 9/1995 | Naylor | |
| 5,529,308 | A | * | 6/1996 | Masakayan | 273/243 |
| 5,607,160 | A | * | 3/1997 | Stevens et al. | 273/249 |
| 5,913,519 | A | * | 6/1999 | Sindelar | 273/248 |

FOREIGN PATENT DOCUMENTS

| | | |
|---|---|---|
| GB | 2059712 | 4/1997 |

* cited by examiner

*Primary Examiner*—Benjamin H. Layno
*Assistant Examiner*—V K Mendiratta

(57) ABSTRACT

A educational game for teaching verses from the bible in an entertaining manner. The educational game includes a game board. A game path is on the game board. The game path is divided into a plurality of game spaces and begins with a starting space and ends with an ending space. Bible indicia are in a plurality of the game spaces. Each of the bible indicia comprises a name of a book contained in a Christian bible. A plurality of scripture cards each has question indicia thereon corresponding to each of the bible indicia. A chance means determines movement about the game path. A plurality of game tokens is used for moving about the game path. The players choose a scripture card if they land on a game space having bible indicia therein, and they recite a verse referred to by the question indicia on the scripture card. The game is won by being the first player to move their token to the finish space.

1 Claim, 3 Drawing Sheets

10

14
15
20
22
24
26
26
26
MATT
REV
LUKE
Q
1COR
Q
JOHN
MARK
Q
ACTS
GAL
SPEC
ROM
1TIM
MATT
JOHN
Q
2COR
LUKE
MARK
Q
ACTS
MARK
1COR
ROM
Q
PHL
JAM
MATT
JOHN
MATT
ROM
LUKE
Q
MARK
JOHN
Q
EPH
ACTS
Q
JOHN
Q
MATT
HEB

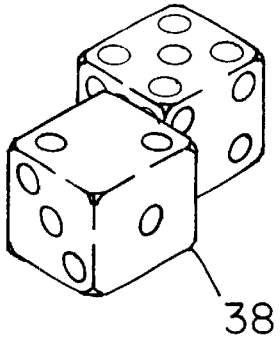
FIG.2
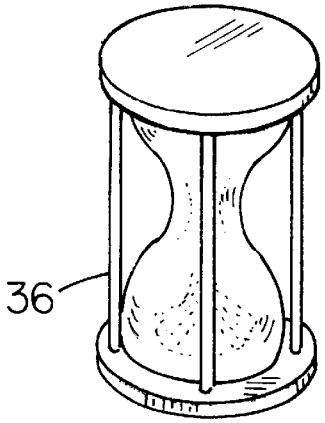
FIG.3
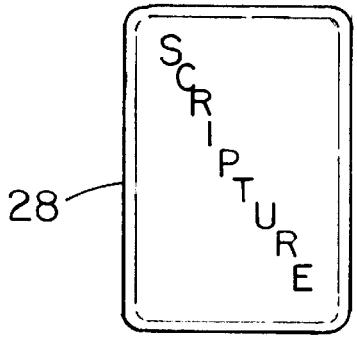
FIG.4
FIG.5
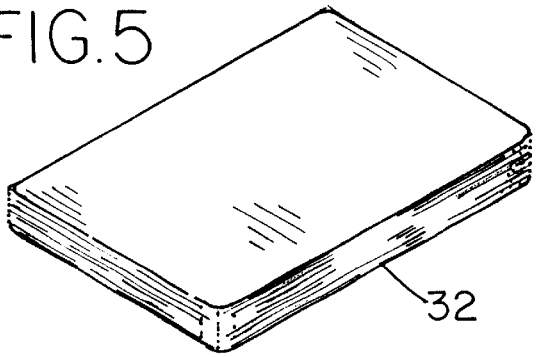
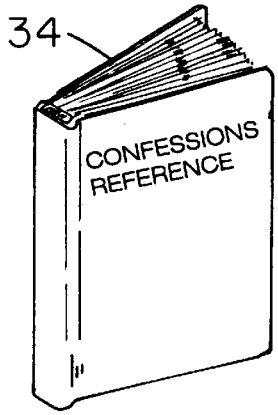
FIG.6
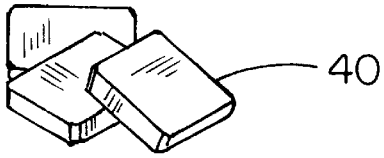
FIG.7
FIG.8
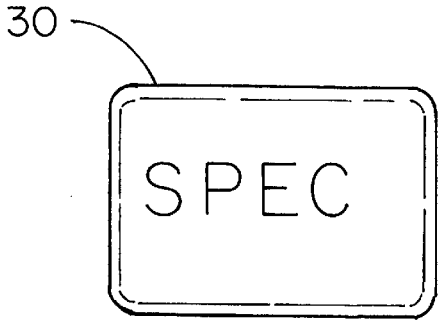

EDUCATIONAL GAME

BACKGROUND OF THE INVENTION

1. Field of the Invention

The present invention relates to board games and more particularly pertains to a new educational game for teaching verses from the bible in an entertaining manner.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,042,816; U.S. Pat. No. 5,152,535; U.S. Pat. No. 5,449,177; U.S. Pat. No. 3,952,423; U.S. Pat. No. 4,441,718; and U.S. Des. Pat. No. 252,344.

While these devices fulfill their respective, particular objectives and requirements, the aforementioned patents do not disclose a new educational game. The inventive device includes a game board. A game path is on the game board. The game path is divided into a plurality of game spaces and begins with a starting space and ends with an ending space. Bible indicia are in a plurality of the game spaces. Each of the bible indicia comprises a name of a book contained in a Christian bible. A plurality of scripture cards each has question indicia thereon corresponding to each of the bible indicia. A chance means determines movement about the game path. A plurality of game tokens is used for moving about the game path. The players choose a scripture card if they land on a game space having bible indicia therein, and they recite a verse referred to by the question indicia on the scripture card. The game is won by being the first player to move their token to the finish space.

In these respects, the educational game according to the present invention substantially departs from the conventional concepts and designs of the prior art, and in so doing provides an apparatus primarily developed for the purpose of teaching verses from the bible in an entertaining manner.

SUMMARY OF THE INVENTION

In view of the foregoing disadvantages inherent in the known types of board games now present in the prior art, the present invention provides a new educational game construction wherein the same can be utilized for teaching verses from the bible in an entertaining manner.

The general purpose of the present invention, which will be described subsequently in greater detail, is to provide a new educational game apparatus and method which has many of the advantages of the board games mentioned heretofore and many novel features that result in a new educational game which is not anticipated, rendered obvious, suggested, or even implied by any of the prior art board games, either alone or in any combination thereof.

To attain this, the present invention generally comprises a game board. A game path is on the game board. The game path is divided into a plurality of game spaces and begins with-a starting space and ends with an ending space. Bible indicia are in a plurality of the game spaces. Each of the bible indicia comprises a name of a book contained in a Christian bible. A plurality of scripture cards each has question indicia thereon corresponding to each of the bible indicia. A chance means determines movement about the game path. A plurality of game tokens is used for moving about the game path. The players choose a scripture card if they land on a game space having bible indicia therein, and they recite a verse referred to by the question indicia on the scripture card. The game is won by being the first player to move their token to the finish space.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new educational game apparatus and method which has many of the advantages of the board games mentioned heretofore and many novel features that result in a new educational game which is not anticipated, rendered obvious, suggested, or even implied by any of the prior art board games, either alone or in any combination thereof.

It is another object of the present invention to provide a new educational game which may be easily and efficiently manufactured and marketed.

It is a further object of the present invention to provide a new educational game which is of a durable and reliable construction.

An even further object of the present invention is to provide a new educational game which is susceptible of a low cost of manufacture with regard to both materials and labor, and which accordingly is then susceptible of low prices of sale to the consuming public, thereby making such educational game economically available to the buying public.

Still yet another object of the present invention is to provide a new educational game which provides in the apparatuses and methods of the prior art some of the advantages thereof, while simultaneously overcoming some of the disadvantages normally associated therewith.

Still another object of the present invention is to provide a new educational game for teaching verses from the bible in an entertaining manner.

Yet another object of the present invention is to provide a new educational game which includes a game board. A game path is on the game board. The game path is divided into a plurality of game spaces and begins with a starting space and ends with an ending space. Bible indicia are in a plurality of the game spaces. Each of the bible indicia comprises a name of a book contained in a Christian bible. A plurality of scripture cards each has question indicia thereon corresponding to each of the bible indicia. A chance means determines movement about the game path. A plurality of game tokens is used for moving about the game path. The players choose a scripture card if they land on a game space having bible indicia therein, and they recite a verse referred to by the question indicia on the scripture card. The game is won by being the first player to move their token to the finish space.

Still yet another object of the present invention is to provide a new educational game that enjoyably teaches people of all ages verses from the bible and various religious rites, actions and facts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a schematic perspective view of dice of the present invention.

FIG. 3 is a schematic perspective view of the timing means of the present invention.

FIG. 4 is a schematic plan view of the scripture cards of the present invention.

FIG. 5 is a schematic perspective view of the player's cards of the present invention.

FIG. 6 is a schematic perspective view of the reference book of the present invention.

FIG. 7 is a schematic perspective view of the tokens of the present invention.

FIG. 8 is a schematic plan view of the special cards of the present invention.

DESCRIPTION OF THE PREFERRED EMBODIMENT

Figures 1, 1A, 1B:
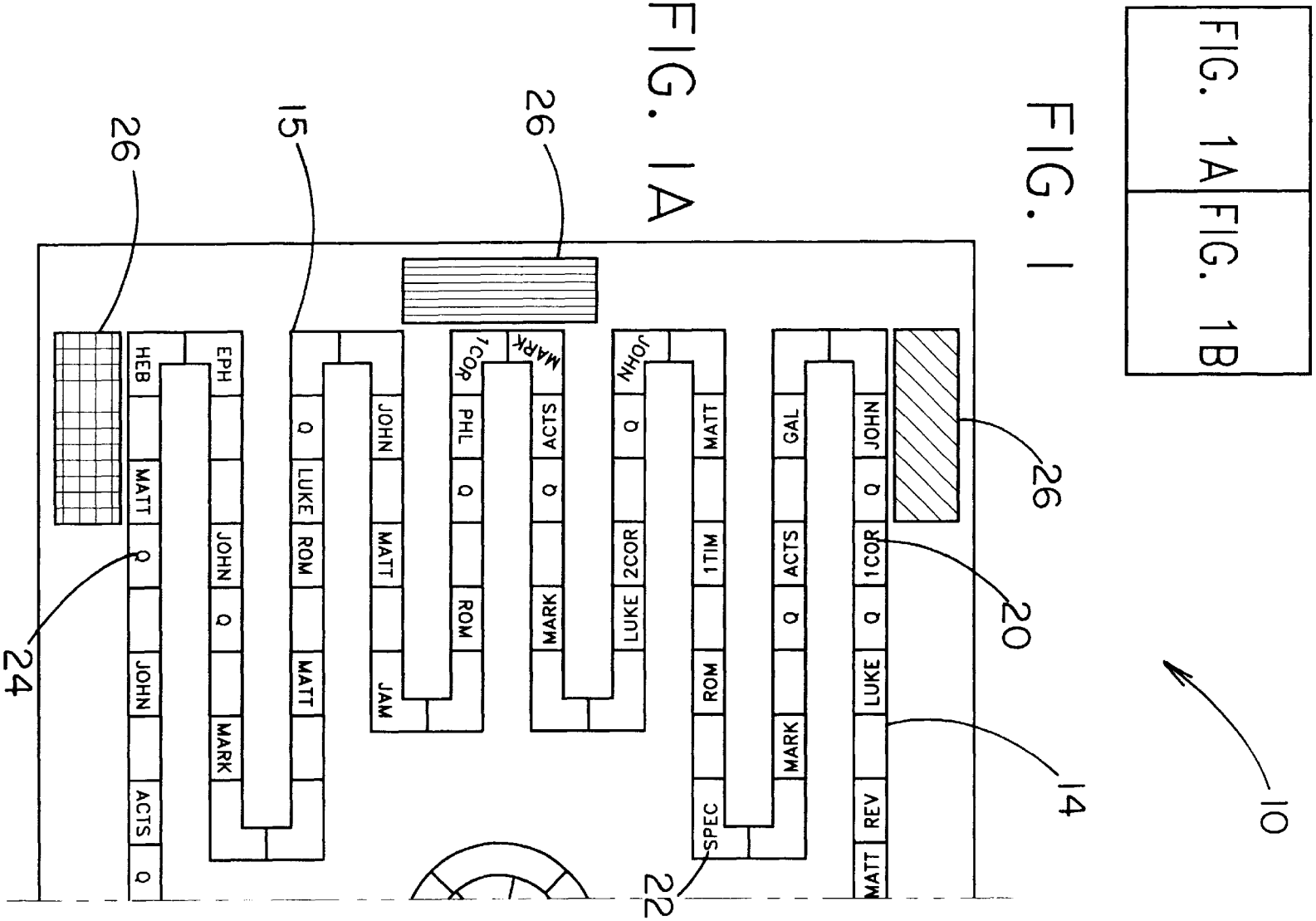
FIG. 1A is a schematic plan view of one half of the game board of a new educational game according to the present invention.
FIG. 1B is a schematic plan view of the second half of the game board.
Figure 1B:
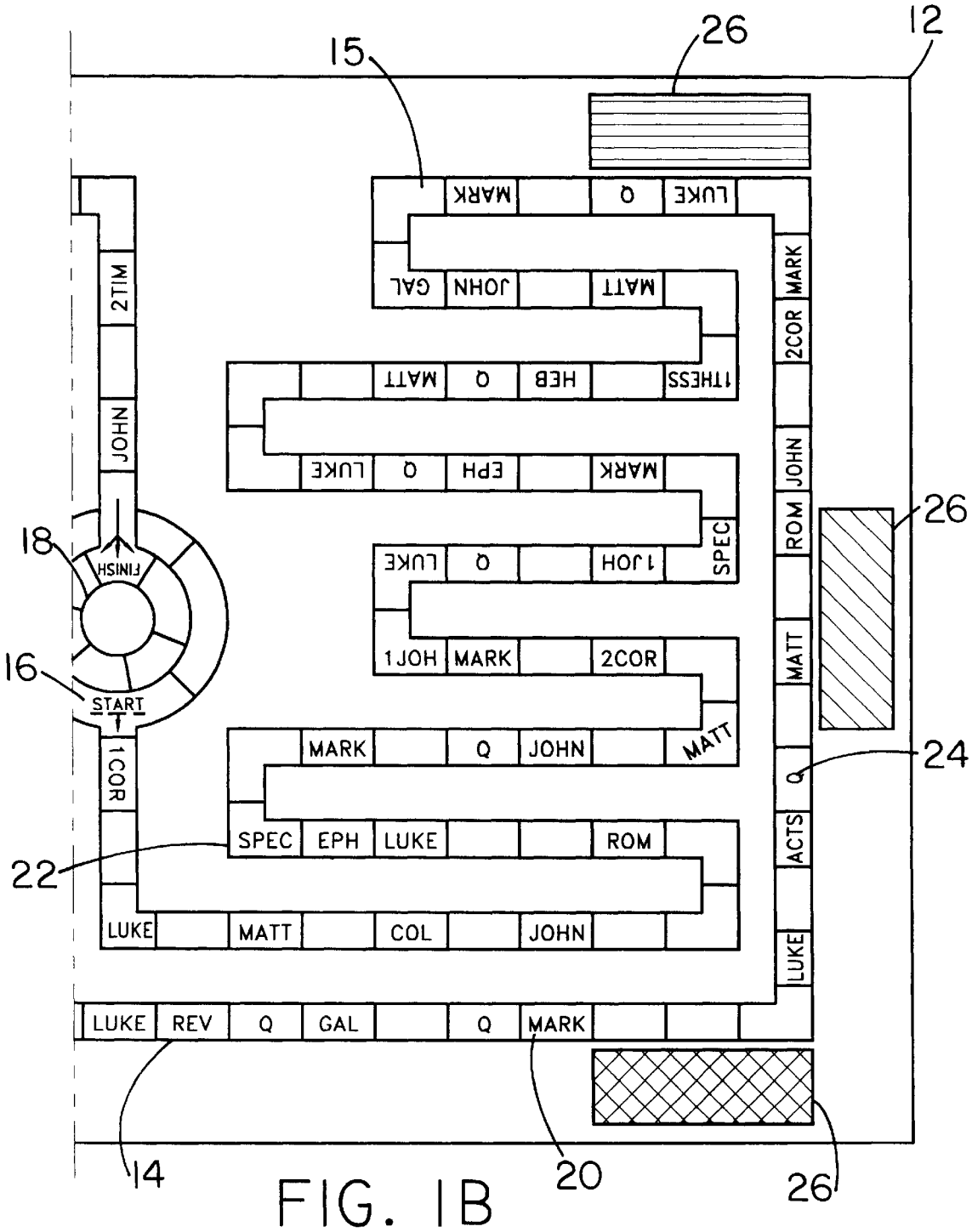

With reference now to the drawings, and in particular to FIGS. 1 through 8 thereof, a new educational game embodying the principles and concepts of the present invention and generally designated by the reference numeral 10 will be described.

As best illustrated in FIGS. 1 through 8, the educational game 10 generally comprises a game board 12. The game board 12 has a top surface and the game board preferably has a generally rectangular shape.

A game path 14 is on the top surface of the game board 12. The game path 14 is divided into a plurality of game spaces 15. The game path 14 has a starting space 16, which is generally positioned in a central area of the game board 14. The game path 14 extends away from the starting space 16 and travels about the game board 12. The game path 14 has an ending space 18. The ending space 18 is within the starting space 16 such that the game path 14 comprises a closed path.

Bible indicia 20 are in a plurality of the game spaces 15. Each of the bible indicia 20 comprises a name of a book contained in a Christian bible such as, but solely comprising, John, Corinthians, Matthew and Revelations.

Special indicia 22 are in a plurality of the game spaces 15, and are designated "SPEC" on the game board.

Color indicia 24 are in a plurality of the game spaces 15, and are designated with the letter "Q." The color indicia are selected from the group consisting of blue, red, yellow, green, orange and brown. Six spaces 26 are placed along the peripheral edge of the board. Each of the spaces corresponds to one of the colors.

A plurality of scripture cards 28 is provided. Each of the scripture cards 28 has question indicia corresponding to each of the bible indicia 20. Each of the scripture cards 28 also has action indicia thereon. The action indicia is selected from the group consisting of moving forward three spaces, moving backward three spaces, going to start, missing a turn, reciting a biblical verse before the next turn, and reciting a biblical verse instead of taking the next turn.

A plurality of special cards 30 each has religion action indicia thereon. The religion action may include, but is not limited to the sign of the cross, Eucharist, and prayer. Each of the special cards 30 has action indicia thereon indicating movement around the game path 14.

A plurality of player's cards 32 each has religion question indicia thereon. The religion question indicia includes general questions regarding the Christian religion. Each of the player's cards 32 has action indicia thereon indicating movement around the game path. The plurality of player's cards 32 is ideally six sets of three player's cards. Each of the sets has different color indicia thereon. The color indicia are selected from the group consisting of blue, red, yellow, green, orange and brown to correspond with the color indicia 24 in the game spaces.

A reference book 34 contains biblical verses therein corresponding to each of question indicia on the scripture cards 28.

A timing means 36 is used for tracking the passage of time. Ideally, the timing means 36 is a one-minute timer. An hour-glass type timer is depicted in FIG. 3.

A chance means 38 is used for determining movement about the game path 14. The chance means 38 is preferably a pair of dice.

A plurality of game tokens 40 is used for moving about the game path 14. Each of the game tokens is colored a different color such that at least one of the game tokens has a color corresponding to one of the sets of the player's cards 32.

Rules of the Game

Each player selects a token.

Each player receives a set of player's cards having color indicia thereon which corresponds to the color indicia on the token chosen by the player.

Each player rolls the pair of dice. The player having highest dice total goes first and play proceeds in a clock-wise fashion thereafter.

The players roll the pair of dice to determine movement about the game board. The player moves their token an amount of spaces on the game path equal to the total indicated on the dice.

A scripture card is chosen if the player lands on a game space having bible indicia therein. The player then attempts to recite a verse referred to by the question indicia on the scripture card as it relates to the bible indicia in the game space. The player completes the action indicia on the scripture card for correctly answering the question indicia. The player may not move their token on that or any successive turn until the question indicia is answered correctly. The player may memorize the verse, which will be found in the reference book before their next turn in order to answer the question indicia correctly.

The player chooses a special card if the player lands on a game space having special indicia therein. The player then performs the action indicated by the religion action indicia on the special card. The other players decide if the player performed the religion action correctly. The player moves the token as directed by the action indicia if the action was correctly performed.

A player asks a religion question indicia from one of their own player's cards if another player lands on a game space having a color indicia thereon. The player's card is chosen such that the color of the player's card corresponds to the color indicia in the game space landed in. The player who landed on the color indicia moves their token as indicated by the action indicia on the player's card if the player on the color indicia answers the religion question indicia correctly.

Each of the answers must be answered within the time allowed by the timing means.

The first player who moves their token to the finish space first wins the game.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes-will readily occur to those skilled in the art, it is not desired to limit the invention to the exact construction and operation shown and described, and accordingly, all suitable modifications and equivalents may be resorted to, falling within the cope of the invention.

I claim:

1. A method of playing an educational game, comprising the steps of:

providing a game board, said game board having a top surface, said game board having a generally rectangular shape;

providing a game path on said top surface of said game board, said game path being divided into a plurality of game spaces, said game path having a starting space, said starting space being generally positioned in a central area of said game board, said game path extending away from said starting space and traveling about said game board, said game path having an ending space, said ending space being within said starting space such that said game path comprises a closed path;

providing bible indicia in a plurality of said game spaces, each of said bible indicia comprising a name of a book contained in a Christian bible;

providing special indicia in a plurality of said game spaces;

providing color indicia in a plurality of said game spaces, said color indicia being selected from the group consisting of blue, red, yellow, green, orange and brown;

providing a plurality of scripture cards, each of said scripture cards having question indicia corresponding to each of said bible indicia, each of said scripture cards having action indicia thereon, said action indicia being selected from the group consisting of moving forward three spaces, moving backward three spaces, going to start, missing a turn, reciting a biblical verse before next turn, and reciting a biblical verse instead of taking the next turn;

providing a plurality of special cards, each of said special cards having religion action indicia thereon indicating a religiously significant action to be performed, each of said special cards having action indicia thereon indicating movement around said game path;

providing a plurality of player's cards, each of said player's cards having religion question indicia thereon, each of said player's card having action indicia thereon indicating movement around said game path, said plurality of player's cards being six sets of three player's cards, each of said sets having a different color indicia thereon, said color indicia being selected from the group consisting of blue, red, yellow, green, orange and brown;

providing a reference book, said reference book having biblical verses therein corresponding to each of question indicia on said scripture cards;

providing a timing means for tracking the passage of time;

providing a chance means for determining movement about said game path, said chance means being a pair of dice;

providing a plurality of game tokens for moving about said game path, wherein each of said game tokens is colored a different color such that at least one of said game tokens has a color corresponding to one of said sets of said player's cards;

providing a plurality of players;

selecting a token by each of said players;

selecting a set of player's cards having a color matching a color of said token;

rolling said pair of dice, wherein said player having highest total indicated on said dice goes first;

rolling said pair of dice to determine movement about said game board, wherein said player moves their token an amount of spaces on said game path equal to a total indicated on said dice;

choosing a scripture card if said player lands on a game space having bible indicia therein and reciting a verse referred to by said question indicia on said scripture card, wherein said player completes said action indicia on said scripture card for correctly answering said question indicia, wherein said player may not move their token on each successive turn until said question indicia is answered correctly, wherein said player may memorize said reference book before a next turn in order to answer said question indicia correctly;

choosing a special card if said player lands on a game space having special indicia therein, wherein said player performs said religion action indicia indicated on said special card, said players deciding if the player performed said religion action correctly, said player moving said token as directed by said action indicia if said religion action indicia was correctly performed;

reading said religion question indicia from one of said player's cards having color indicia thereon corresponding to said color indicia of a game space landed on by said player if said player lands on a game space having a color indicia thereon, and wherein said player moves their token as indicated by said action indicia on said player's card if said player gives a correct answer to said religion question indicia;

timing each of said answers with said timing means, wherein answers must be provided before the time being calculated by said timing means expires; and winning the game by the player to move their token to said finish space first.

* * * * *